US005489415A

United States Patent [19]

Van Vlahakis et al.

[11] Patent Number: 5,489,415

[45] Date of Patent: Feb. 6, 1996

[54] URINAL BLOCK DISPENSER ASSEMBLY AND COMPOSITION

[75] Inventors: Eftichios Van Vlahakis, 16727 Bolero La., Huntington Beach, Calif. 92649; John A. Manolas, Lake Forest; Michael J. Marrese, Park Ridge, both of Ill.

[73] Assignee: Eftichios Van Vlahakis, Huntington Beach, Calif.

[21] Appl. No.: 261,338

[22] Filed: Jun. 16, 1994

Related U.S. Application Data

[63] Continuation of Ser. No. 996,055, Dec. 23, 1992, abandoned.

[51] Int. Cl.[6] ..... E03D 9/02

[52] U.S. Cl. ..... 422/264; 422/276; 4/222; 4/231

[58] Field of Search ..... 422/264, 266, 422/276, 277; 4/222, 223, 224, 231, 232

[56] References Cited

U.S. PATENT DOCUMENTS

| | | | |
|---|---|---|---|
| 3,597,772 | 8/1971 | Leavitt et al. | 4/222 |
| 3,723,327 | 3/1973 | van Kampen et al. . | |
| 3,760,429 | 9/1973 | Brownstein | 4/222 |
| 3,798,181 | 3/1974 | Vazquez . | |
| 3,824,633 | 7/1974 | Vlahakis . | |
| 3,840,480 | 10/1974 | Barrat et al. . | |
| 4,096,593 | 6/1978 | Vlahakis . | |
| 4,103,367 | 8/1978 | Kauter | 4/222 |
| 4,135,261 | 1/1979 | Uhrman | 4/222 |
| 4,318,193 | 3/1982 | Bayer et al. | 4/222 |
| 4,477,363 | 10/1984 | Wong et al. . | |
| 4,574,403 | 3/1986 | Dintemann et al. | 4/222 |
| 4,604,357 | 8/1986 | Callewaert et al. . | |
| 4,722,801 | 2/1988 | Bunczk et al. . | |
| 4,911,858 | 3/1990 | Bunczk et al. . | |
| 5,019,346 | 5/1991 | Richter et al. | 422/264 |
| 5,030,378 | 7/1991 | Venegas . | |
| 5,064,561 | 11/1991 | Rouillard . | |

FOREIGN PATENT DOCUMENTS 61-231094 10/1986 Japan .

*Primary Examiner*—Timothy M. McMahon
*Attorney, Agent, or Firm*—Wallenstein & Wagner, Ltd.

[57] ABSTRACT

The present invention relates to an improved urinal block composition comprised of fluid-soluble chemical components, and an improved dispenser to be used with that urinal block. Specifically, the present invention is directed to a unique combination of chemicals that when blended together to form a urinal block composition yields a stable product that is effective at deodorizing and cleaning urinals and toilets. The improvement of using an acid stable protease enzyme with the other fluid-soluble chemical components of the urinal block composition provides the advantage of dissolving and otherwise neutralizing odors associated with urinals and toilets. The urinal block is retained in and dispensable from a disposable dispenser assembly 10 for use in urinals and toilets. The urinal block is protected from direct action of urine by a retention cup 18 which retains the chemical block composition 32 in position, and the inner hollow area 12 of the dispenser 10 allows the dispenser 10 to fit around strainers found in urinals. The dispenser has a perforated flange 20 that supports the hollow area 12 and retention cup 18 within the urinal, while also allowing for effective drainage.

7 Claims, 2 Drawing Sheets

URINAL BLOCK DISPENSER ASSEMBLY AND COMPOSITION

This is a continuation of application Ser. No. 07/996,055 filed on Dec. 23, 1992 now abandoned.

TECHNICAL FIELD

The present invention relates to an improved urinal block composition comprised of fluid-soluble chemical components, and an improved dispenser assembly to be used with that urinal block. Specifically, the present invention is directed to a unique combination of chemicals that when blended together to form a urinal block composition yields a stable product that is effective at deodorizing and cleaning urinals and toilets. The improvement of using an acid stable protease enzyme with the other fluid-soluble chemical components of the urinal block composition provides the advantage of dissolving and otherwise neutralizing odors associated with urinals and toilets. The urinal block is retained in and dispensable from a disposable dispenser assembly for use in urinals and toilets. The dispenser comprises an inverted oval-shaped retention cup which holds the urinal block in position. The dispenser also has a perforated flange that supports an inner hollow area and retention cup within the urinal, while also allowing for effective drainage. The unique hollow design of the dispenser allows it to fit around strainers found in urinals.

BACKGROUND PRIOR ART

One of the earliest efforts at providing health protection for urinals was to use a solid block of paradichlorobenzene (PDB). These blocks were not positioned in the urinal in any particular way. Rather, they were merely tossed into the urinal. Since PDB sublimed at room temperature, it had a characteristic odor in use. However, PDB is substantially insoluble in water. As a result, the PDB evaporated continuously, rather than being dispensed at the time of flushing. As the blocks evaporated whether or not there was a need for the PDB, the blocks required frequent replacement. Because of the relatively rapid, continuous attrition by evaporation, custodial personnel could miss a needed replacement. In that case, the urinal would have no protection. In addition, since PDB is highly crystalline, the blocks tended to crack in use. The small pieces would then be either flushed away or lodged out of their position in the urinal where they would not be able to evaporate causing clogging of pipes.

Later, perfumes and germicides were added to PDB blocks. This improved the ability of the blocks to provide some cleaning and odor-covering properties. However, the blocks still sublimed at room temperature and were insoluble in water. The problem of unnecessary use at some times, followed by no use at others, was not solved. There also remained the problem of non-uniform distribution of the chemical, since the perfumed PDB blocks were still merely thrown into the urinal, and as a result sometimes cracked.

Another approach was to anchor PDB blocks by means of a wire loop hooked over the edge of the urinal or toilet. Also, exposed blocks have been secured to a plastic screen backing. Neither of these methods prevented cracking or subliming.

PDB or urine-soluble chemical blocks have been provided in a two-piece assembly. These two pieces include a separate screen and an open mesh cup secured to that screen. This did not solve the problem of continuous sublimation in the case of a PDB block placed in the screen mesh cup. In the case of fluid-soluble chemicals, there remains the problem of wasteful attrition of the chemical by the direct action of the urine impinging on the exposed blocks. Introduction of excess chemicals into the water supply also may aggravate water pollution.

In all of the aforementioned methods, the blocks and holder parts were manufactured separately and then assembled in expensive, multistep operations.

A disposable dispenser assembly for fluid-soluble chemicals that must slowly be released at prescribed times, and a method of manufacture of the chemicals and the dispenser assembly, was disclosed in U.S. Pat. No. 3,824,633 to E. Van Vlahakis, one of the co-inventors of the present invention. In addition, a toilet bowl dispenser assembly for controlled release of bactericidal, deodorizing agents from a solid type cake was disclosed in U.S. Pat. No. 4,096,593 to Vlahakis. Other inventions relating to urinal and toilet bowl disinfectant blocks include U.S. Pat. No. 4,604,357 to Callewaert et al., U.S. Pat. No. 4,722,801 to Bunczk et al., and U.S. Pat. No. 4,911,858 to Bunczk et al.

However, the present invention is an improvement over the prior art. The urinal block composition of the present invention includes the addition of a proteolytic enzyme (preferably protease), and this marks the first time a specific enzyme that targets proteins has been successfully added to a urinal block system with a pH below 4.0. This discovery is important because it allows the proteolytic enzyme to be encapsulated into a water activated, pre-measured dosage that is released with each flush of the urinal or toilet. In addition, it allows the proteolytic enzyme to work over a long period of time in a stable environment. The lowering of the pH does not have a detrimental effect on the proteolytic enzyme or germicide components. The higher concentration of acid also allows the product to neutralize more urine bases than before, and provides the added benefits of cleaning and shining of the porcelain fixtures.

The dispenser assembly of the present invention is also an improvement over the prior art. Previously, urinal blocks, with or without screens, were placed beside or on top of stainless steel strainers found in urinals. Such placement is neither aesthetically pleasing nor efficient, since the urinal block and/or dispenser could easily be displaced. However, one embodiment of the dispenser assembly of the present invention provides for an oval-shaped dispenser having an inner hollow design that allows the dispenser and retained urinal block to fit around a stainless steel strainer, without impeding the purpose of the strainer. In addition, the hollow sphere has elongated perforations in it to allow for the passage of liquids, for aeration, and for aesthetic purposes. A perforated flange surrounds the urinal block and hollow sphere and serves to support the dispenser in the desired location within the urinal while also serving to allow effective drainage of the urine. Thus, the present invention overcomes the deficiencies associated with the prior art by providing an improved urinal block composition and dispenser assembly that sanitizes and deodorizes urinals or toilets in a selective manner, is easily manufactured and assembled, and is long-lasting.

SUMMARY OF THE INVENTION

The present invention is directed to an improved urinal block composition adapted to be retained in and dispensable from an improved disposable assembly. Specifically, the urinal block composition is comprised of a group of fluid-soluble chemicals which are dispensed at selected times, in desired amounts, in a substantially uniform fashion. This group of fluid-soluble chemicals includes an acid, a proteolytic enzyme, an amphoteric surfactant, a non-ionic surfactant, a germicide, a starch, an essential oil and a dye.

The urinal block composition is retained in and dispensable from a disposable dispenser assembly for use in urinals and toilets. In a principal embodiment, the dispenser comprises an inverted oval-shaped cup in which the fluid-soluble chemical or urinal block is disposed. The dispenser has an inner hollow perforated sphere and an outer perforated flange, both providing for passage of fluids. In use, the dispenser assembly is placed in a fluid receptacle in such a manner that the chemical is supported above the normal fluid level by the perforated flange, and the dispenser is placed over strainers found in the urinal. When the fluid level in the urinal or toilet rises, or turbulence in the receptacle is high, this fluid is able to make contact with the exposed undersurface of the urinal block. The fluid-soluble chemicals of the urinal block composition then dissolve in a preselected quantity into the receptacle area.

The urinal block composition is easily and economically manufactured, with the most critical factor in the manufacturing process being the temperature control. Initially, all of the chemical components except the enzyme, essential oil, and dye, are uniformly mixed together at a high temperature. The temperature is then lowered and the enzyme, essential oil, and dye are added. Finally, a measured amount of the fluid-soluble chemical composition is filled into the dispenser assembly. The chemical composition is allowed to set, and subsequently forms a solid block.

The dispenser and urinal block are simply manufactured in a unitary assembly by pouring the chemical into the protective cup in a fluid state and allowing it to set. Optionally, an appropriate attaching means is provided in the cup to assist in securing the chemical to the dispenser cup in a position ready for use.

It is among the aspects of the present invention to provide an improved urinal block composition comprised of fluid-soluble chemical components wherein the urinal block is retained in and dispensable from a disposable dispenser assembly for use in urinals and toilets. The addition and use of a proteolytic enzyme in combination with the other fluid-soluble chemical components of the urinal block composition provides the added advantage of dissolving and otherwise neutralizing odors associated with urinals and toilets. Thus, the unpleasant ammonia odor associated with urine decomposition is eliminated or reduced.

It is another aspect of the present invention to provide an improved dispenser assembly for retaining a urinal block for use in urinals and toilets. The unique design of the dispenser includes a hollow sphere which allows the dispenser to fit around strainers found in urinals.

It is another aspect of the present invention to lower the pH of the product to from about 1.8 to about 6.5 in order to aid in the elimination of the ammonia odor associated with urine. Lowering the pH has been found to have no adverse effect on the protease or germicide components of the product. In addition, the more acidic composition allows the product to neutralize more of the urine bases than prior art blocks, and to clean and shine the porcelain fixtures more efficiently than prior art blocks.

It is another aspect of the present invention to encapsulate the protease enzyme, along with the other fluid-soluble chemical components, into a water activated, pre-measured dosage that is released with each flush of the urinal or toilet. This allows the urinal block to work over a more extended period of time.

It is another aspect of the present invention to add an amphoteric surfactant to the chemical composition to increase the wetting and detergent capabilities of the product. This surfactant also enhances cleaning and foaming characteristics without adversely affecting the protease or germicide components of the product.

It is another aspect of the present invention to provide an improved urinal block composition which has both a long and uniform shelf life, and a long use or block life, while still effectively deodorizing and disinfecting the urinals or toilets over that prolonged life.

It is another aspect of the present invention to provide a simple, economical process of manufacture of a chemical-containing dispenser by utilizing the dispenser as a mold for the fluid-soluble chemical components of the improved urinal block composition.

It is another aspect of the present invention to provide an optional means for securing the urinal block to the dispenser assembly.

Other advantages and aspects of the present invention will become apparent upon reading the following description of the drawings and the detailed description of the invention and preferred embodiments of the invention.

BRIEF DESCRIPTION OF THE DRAWINGS

In the detailed description which follows, reference will be made to the following figures, in which.

DETAILED DESCRIPTION OF A PREFERRED EMBODIMENT

Figure 1:
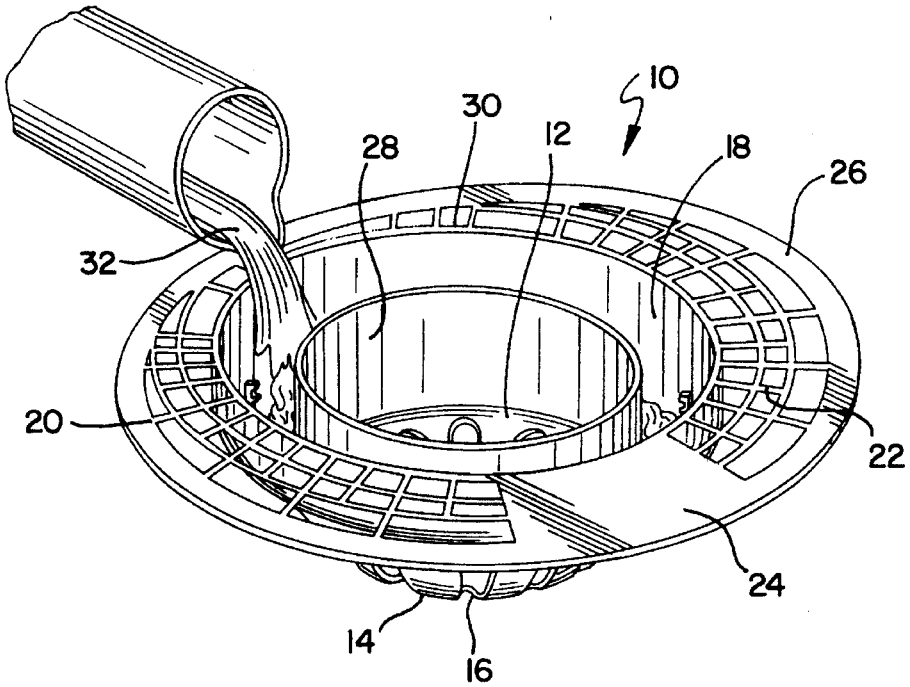
FIG. 1 is an inverted perspective view of one embodiment of a dispenser in accordance with this invention, showing the method of filling the dispenser with fluid-soluble chemical components in a molten condition during manufacture.

While this invention is susceptible of embodiment in many different forms, there is shown in the drawings and will herein be described in detail, preferred embodiments of the invention. The present disclosure is to be considered as an exemplification of the principles of the invention and is not intended to limit the broad aspect of the invention to the embodiments illustrated.

The present invention is directed to an improved urinal block composition and dispenser assembly used to disinfect and deodorize urinals and toilets.

FIG. 1 illustrates a preferred embodiment of an inverted unitary dispenser assembly 10 of the present invention. The dispenser assembly 10 is substantially oval-shaped and includes a hollow area 12 with a sphere-shaped top 14 having perforations 16, a chemical block retention cup 18, and a flange 20, shown around the periphery of the cup 18, which has a perforated netting 22, a stamp area 24, and a plastic rim 26. The position of the flange 20 around the periphery of the cup 18 is by way of illustration only and not by way of limitation. The cup 18 has an inner wall 28 which separates the cup from the hollow area 12. Referring to FIG. 1, the inner wall 28 is shown at a slightly lower level than the edge 30 of the flange 20, when the dispenser assembly 10 is in the inverted position.

The dispenser assembly 10 is shown being filled with a fluid-soluble chemical composition 32 in a fluid state during manufacture. The method of manufacture consists of molding the hollow sphere 14, the retention cup 18 and the perforated flange 20 by injection molding in a unitary fashion, thereby forming the appropriate dispenser assembly 10; preparing the chemical composition 32 in a fluid state; and, then pouring the chemical into the inverted cup 18 as shown in FIG. 1. Thus, the inverted cup 18 acts as a mold for the chemical 32, with the dispenser assembly 10 receiving the chemical 32 and retaining it within the cup 18 until sufficient time has passed to allow the chemical 32 to solidify, set or dry. Once the chemical 32 has set, dried, or solidified, the dispenser assembly 10 becomes a unitary assembly. The dispenser assembly 10 is then ready for packaging.

Typical materials useful for molding the assembly include polyolefins, such as polyethylene, polypropylene, and the like, styrene or styrene-butadiene polymers or copolymers, ABS, acrylics, urethanes, polyvinyl chloride, and the like. Preferably a low density polyethylene is used. The dispenser assembly 10 is preferably of a transparent polymer in order to make it possible to determine when the chemical 32 has been completely exhausted so that a replacement dispenser may be immediately installed and the empty dispenser discarded.

Figure 2:
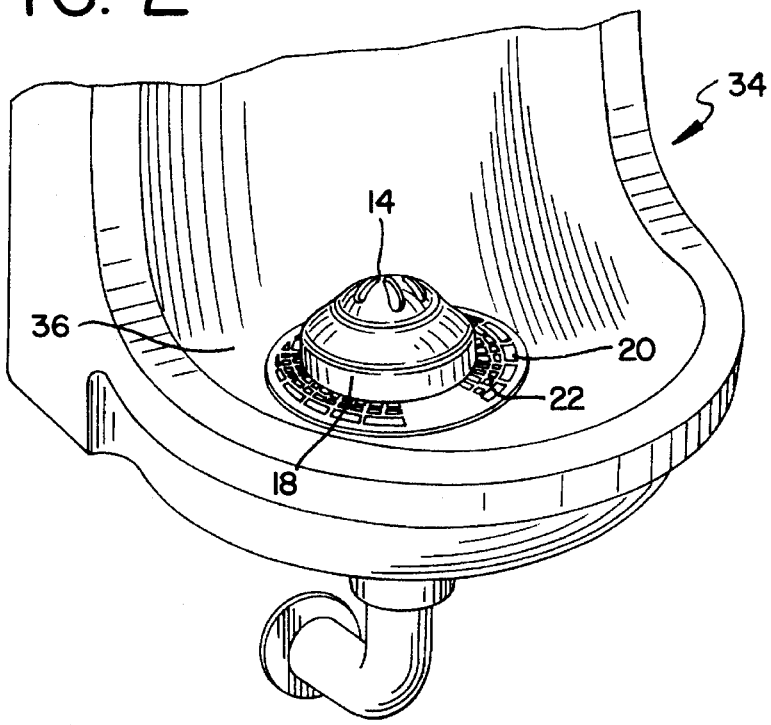
FIG. 2 is a perspective view of the dispenser of FIG. 1 in accordance with the invention, and in a use position.

FIG. 2 shows the dispenser assembly 10 in use in a fluid receptacle, such as a urinal 34. The perforated flange 20 serves to retain the cup 18 and hollow sphere 14 in the desired location within the urinal 34, while also serving to allow effective drainage of the fluid down the drain (not shown). The netting 22 is for aesthetic purposes and helps to keep cigarette butts, paper, and like materials from entering and clogging the drain. In addition, the netting 22 of the flange 20 provides weight to the dispenser assembly 10 to retain it in position over stainless steel strainers (not shown) sometimes found in urinals. The flange 20 is in contact with a porcelain surface 36 of the urinal 34. Prior to the present invention, urinal blocks, with or without screens or dispensers, were placed beside or on top of the strainers, and were easily displaced when the urinal was used. The stamp area 24 of the flange 20 is for placement of a manufacturer's name or other information. The plastic rim 26 of the flange 20 aids in retention and placement of the dispenser assembly 10.

The flange 20 may be of any durable material having sufficient rigidity to support the cup 18 and hollow area 12 in use in the urinal 34 above the normal fluid level, as illustrated in FIG. 2, while at the same time allowing for complete fluid drainage through the flange 20 and hollow sphere 14. The retention cup 18 acts to protect the fluid-soluble chemical 32 from direct fluid action from above the dispenser assembly 10. The perforated flange 20 supports the dispenser assembly 10 in such a manner that only when the fluid level in the fluid receptacle or urinal 34 rises, or when the turbulence of fluid in the urinal 34 is high, will the fluid make contact with the exposed undersurface of the chemical 32. The chemical 32 then dissolves in a preselected quantity into the receptacle area. In this way, the chemical 32 is not wasted, and it is economical to dispose of the dispenser assembly 10 upon complete exhaustion of the chemical 32.

Figure 3:
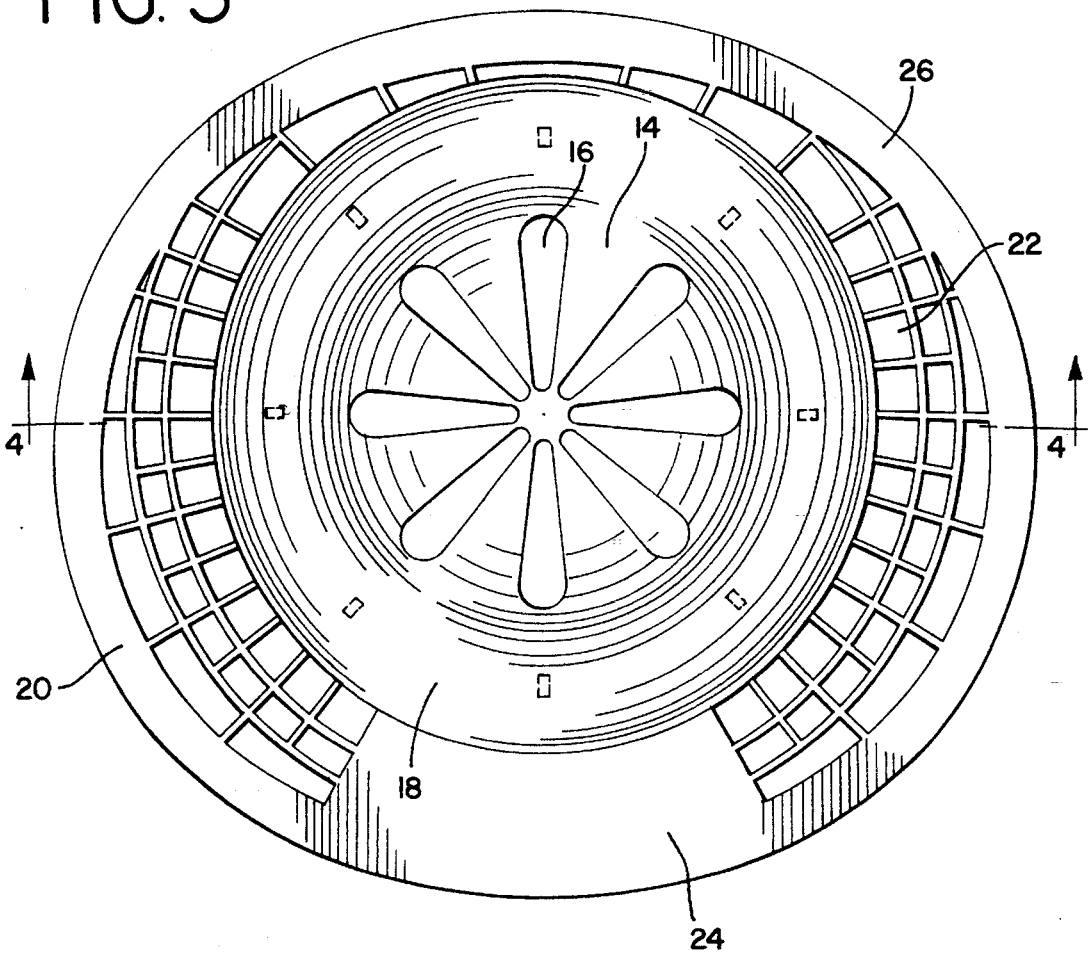
FIG. 3 is a top view of the dispenser of FIG. 1 in accordance with the invention; and, FIG. 4 is a cross-sectional view of the dispenser of FIG. 1 in accordance with the invention, taken along the line 4—4 in FIG. 3.

FIG. 3 is a top view of the dispenser assembly 10 of the present invention. As is shown, the hollow sphere 14 has eight elongated tear-drop shaped perforations 16 at its top. It is appreciated that the number of perforations is by way of illustration only and not by way of limitation. The perforations 16 allow for venting or aeration of the chemical block in the retention cup 18 and also allow for the passage of liquids for effective drainage of the liquids. However, the inner wall 28 separates the hollow area 12 from the retention cup 18 so that the fluid-soluble chemical block 32 is protected from direct fluid action. The dispenser assembly 10 is of sufficient strength and durability to last the life of the fluid-soluble chemical block 32, and is sufficiently economical to be disposed of upon completion of use.

Figure 4:
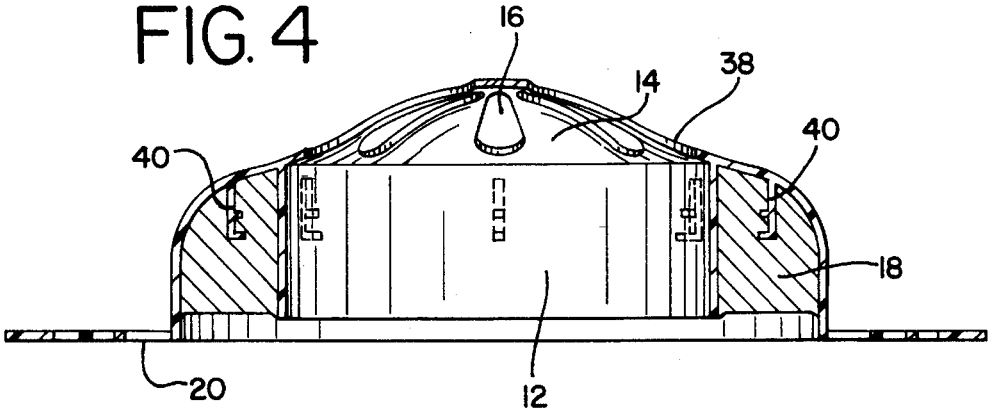

FIG. 4 shows a cross-sectional side view of the dispenser assembly 10 when in position for use. As is shown, the upper surface 38 of the assembly 10 is dome-shaped so that the upper hollow sphere 14 is higher than the retention cup 18 area and the flange 20. No matter what fluid-soluble chemical block 32 is used, an optional means for securing the chemical 32 to the cup 18 may be used. Clips 40 are located in the interior of cup 18 and project downwardly from the upper interior surface of the cup 18. The clips 40 assist in securing the chemical 32 in a position ready for use with cup 18. The fluid chemical 32 poured into cup 18 solidifies around the clips 40 and secure the chemical 32 in the cup 18.

It should be noted that the oval-shaped dispenser assembly 10 of FIGS. 1–4 is merely by way of illustration and not by way of limitation. It is appreciated that the dispenser assembly 10 may be triangular, circular, hexagonal, octagonal or of any suitable shape and size, and the hollow area 12, cup 18, and flange 20 may be suitably related to perform any desired fluid-soluble chemical composition dispensing operation.

The improved urinal block composition retained in the dispenser assembly is an antimicrobial disinfectant having an operative service life of an extended duration, i.e. approximately 30 days. A typical urinal block composition may include organic acids and mineral acids. The preferred acid is phosphoric acid. The amount of acid employed in the chemical composition should be sufficient to neutralize urine bases and form soluble, non-corrosive urine salts. In addition, the acid used should be in an amount of from about 3.0% to about 8.0% by weight of the composition and in an amount sufficient to achieve a pH of from about 1.8 to about 6.5. Preferably, the acid should be in an amount sufficient to achieve a pH of from about 3.0 to about 4.0.

A typical urinal block composition may also include a proteolytic enzyme. The preferred proteolytic enzyme is protease. The addition of protease marks the first time a specific enzyme that targets proteins has been successfully added to a urinal block system with a pH below 4.0. In order to verify that the protease in the product is stable throughout the manufacturing process and the storage life of the product, samples of the protease were analyzed using Acid Stable Protease. Acid Stable Protease is manufactured by a fermentation process of *Aspergillis niger* on wheat or bran, extracted with water, purified with ethanol and standardized to an activity of 5000 Acid Stable Protease units per gram (ASPu/gm). The theoretical Acid Stable Protease units per gram (ASPu/gm) is 200. As shown in Table 1, the average for the 5 sample runs was 196.1 and was within the margin of error for the test procedure. The results verified that the protease was stable both in the manufacturing process and during the shelf life. Thus, the preferred amount of protease used in the present invention is in an amount sufficient to have a theoretical yield of 200 ASPu/gm and in an amount of from about 3.0% to about 8.0% by weight of 5000 ASPu/gm. For example, both 4.0% by weight of 5000

ASPu/gm and 8.0% by weight of 2500 ASPu/gm would yield an activity of 200 ASPu/gm.

The urinal block composition may also include an amphoteric surfactant in an amount of from about 2.0% to about 4.0% by weight of the composition, and in an amount sufficient to increase wetting properties. The preferred amphoteric surfactant is cocoamidopropyl betaine, also known by the trade name MAFO CAB.

The urinal block composition may also include a non-ionic surfactant containing a sufficient amount of ethylene oxide to provide a urinal block melting point temperature of above approximately 100° F. Preferably, the non-ionic surfactant contains a sufficient amount of ethylene oxide to provide a melting point temperature in the range of from about 100° F. to about 150° F. The non-ionic surfactant should preferably be in an amount of from about 50.0% to about 70.0% by weight of the composition. The preferred high-foaming non-ionic surfactant is POE (100) Nonylphenol or Nonoxynol 100, also known by the trade name Iconol NP 100.

The urinal block composition may also include a germicide which acts to disinfect and reduce the bacterial count on urinal and toilet surfaces. The preferred germicide is didecyl dimethyl ammonium chloride, also known by the trade name BARDAC 2250.

The urinal block composition may also include a starch. The preferred starch is corn starch, which provides a consistent texture to the composition for ease in mixing and holding the components together.

The urinal block composition may further include an essential oil that acts as a perfume agent to enhance the odor characteristics of the product. Specific examples of suitable essential oils may include cinnamon, green apple, citrus, baby powder, herbal, spice, jasmine and others.

Finally, the urinal block composition may also include a color dye to enhance the physical appearance of the product and to color code the product. Generic dyes which are stable in acids may be used. The preferred dye is rhodamine.

In the manufacture of the urinal block, the most critical factors include (1) the heating temperatures and (2) the addition of the enzyme, essential oil, and dye in the last step and at a lower temperature, so that they do not evaporate. Water-soluble polymeric materials of relatively high melting point may be added to the composition to control the melting point of the fluid-soluble chemicals. This addition will ensure that the fluid-soluble chemicals will not melt at ambient use temperatures, but will dissolve in the wash or feed water at the required rate. Control of the melting point permits use of various kinds of materials, such as plastic, metal or treated paper, for the dispenser assembly to which the urinal block composition is retained.

In the preferred process of manufacturing the urinal block composition, the non-ionic surfactant is first heated in a large tank which has heating bands surrounding it. The non-ionic surfactant is heated to a temperature of from about 110° F. to about 150° F. The molten liquid non-ionic surfactant is then transferred by pump to a larger mixing vessel. The amphoteric surfactant, acid, germicide, and starch are then added to the mixing vessel, in the proper amounts as described above. The order that these components are added is not critical to the invention. As each component is added, the composition is continuously mixed and blended with an electric motor having an attached agitator working at approximately 750 rpm. The temperature is then lowered to from about 110° F. to about 130° F. and the enzyme, essential oil, and dye are added. The composition is continuously mixed and samples of the composition are taken from the top and bottom of the mixture to determine when the composition is thoroughly mixed, that is, when the pH, the color and the consistency are uniform. Once it is determined that the composition is thoroughly blended and while it is still in a molten state, the composition is pumped from the mixing vessel into a multi-head piston filler, such as the type manufactured by Simplex. A piston filler having three or four nozzles or prongs is preferred over a single nozzle piston filler, because the multi-head piston filler provides a smoother fill, less air in the liquid, and less cracks. The piston filler is used to inject a measured amount of the composition into the dispenser assembly shown in FIG. 1. It is appreciated, however, that other dispenser assembly embodiments may be used with the urinal block composition. The dispensers holding the composition are cooled by placing the dispensers on a conveyor belt and sending them through a tunnel that blows cold air on them from an air conditioning unit attached to the tunnel. This cooling process lasts from about 3 minutes to about 5 minutes. An alternative to cooling the composition through the tunnel is to set the dispensers with the composition on a shelf or near an open window and letting them air dry.

The filling of the composition into the dispensers takes about several hours, and the amount of composition prepared is limited to the amount that is to be filled on a particular day. Once the urinary block composition has set, dried or solidified in the dispenser assembly, the urinary block composition and the dispenser assembly become a unitary assembly.

Only when the fluid level in the fluid receptacle rises, or when the turbulence of fluid in the receptacle is high, will the fluid or flush water make contact with the exposed undersurface of the urinal block composition. Through this liquid contact, a relatively uniform amount of the fluid-soluble chemicals in the urinal block dissolve into the receptacle area. In this way, the chemicals in the urinal block are dispensed only upon demand, and the urinal block composition is not wasted through evaporation. The dispenser assembly is disposed upon complete exhaustion of the urinal block composition.

The following example illustrates a preferred preparation of a urinary block composition and various tests run on the composition to determine its efficiency.

EXAMPLE I

A urinal block composition is prepared from the following components:

| COMPONENT | PERCENT BY WEIGHT OF COMPOSITION |
|---|---|
| Phosphoric Acid | 7.1% of a 75% solution |
| Acid Stable Protease | 4.0% of 5000 ASPu/gm |
| MAFO CAB (Amphoteric Surfactant) | 3.0% of 30.0% concentr. |
| ICONOL NP 100 | 59.3% |
| BARDAC 2250 (Germicide) | 2.0% |
| Corn Starch (Starch) | 18.6% |
| Perfume (Essential Oil) | 6.0% |
| Rhodamine (Dye) | <.1% |

The amount of composition prepared at one time is limited to the amount that is to be filled in the dispensers on a particular day. First, the Iconol NP 100 is heated to its melting point which is at a temperature of from about 120° F. to about 150° F. It is heated in a 55 gallon drum that has heating bands surrounding it which heat and liquefy the Iconol. The Iconol is heated in this manner for about 24 to about 48 hours, depending on the size of the batch and heating temperature used.

After the Iconol has been sufficiently heated and liquefied, the Iconol is pumped into a 500 gallon jacketed stainless steel mixing vessel. The following pre-weighed components are then added one at a time to the mixing vessel: MAFO CAB, corn starch, BARDAC 2250, and phosphoric acid. Each component is thoroughly blended with the other components in the mixing vessel with an electric motor that has an attached agitator working at approximately 750 rpm. The mixing time for this step is approximately 30 minutes.

The temperature of the mixture is them lowered to from about 110° F. to about 130° F. At this temperature the following pre-weighed components are added one at a time to the mixture: essential oil, protease enzyme, and dye. Each component is thoroughly blended with the other components mixed in the mixing vessel. The mixing time for this step is approximately 15 minutes.

Next, a sample of the composition is taken from the top and bottom of the mixture to determine when the composition is thoroughly mixed, that is, when the pH, the color and the consistency are uniform. Once it is determined that the composition is thoroughly blended and while it is still in a molten state, the composition is pumped from the mixing vessel into a multi-head piston filler, such as the type manufactured by Simplex. A piston filler having three or four nozzles or prongs is preferred over a single nozzle piston filler, because the multi-head piston filler provides a smoother fill, less air in the liquid, and less cracks. The piston filler is used to inject a measured amount of the composition into the dispenser assembly shown in FIG. 1. It is appreciated, however, that other dispenser assembly embodiments may be used with the urinal block composition. The dispensers holding the composition are cooled by placing the dispensers on a conveyor belt and sending them through a tunnel that blows cold air on them from an air conditioning unit attached to the tunnel. This cooling process lasts from about 3 minutes to about 5 minutes. An alternative to cooling the composition through the tunnel is to set the dispensers with the composition on a shelf or near an open window and letting them air dry.

The filling of the composition into the dispensers can last several hours. Once the urinary block composition has set, dried or solidified in the dispenser assembly, the urinary block composition and the dispenser assembly become a unitary assembly.

Urinal blocks were assayed for Acid Stable Protease at 0, 30, 60, 90 and 120 day intervals to determine enzyme stability. Acid Stable Protease is manufactured by fermentation process of *Aspergillis niger* on wheat or bran, extracted with water, purified with ethanol and standardized to an activity of 5000 Acid Stable Protease units per gram (ASPu/gm). This activity is defined as the quantity of enzyme necessary to produce amino acids equivalent to 100 milliequivalents of Tyrosine in one (1) ml of 1.5% Milk Casein filtrate per sixty (60) minutes at 37° C. The assay method has an accuracy of plus or minus 5.0%.

The characteristics of the enzyme research and development Acid Stable Protease include the following:

1. white to slightly yellow powder;
2. stable in a pH range of 2–7 with an optimum pH activity of 2–4;
3. heat stable with an optimum activity ranging from 30° C. to 55° C.; and,
4. nontoxic and nonpathogenic, applicable for use in pharmaceutical, food, and animal feed supplements.

Since the average of the sum of the results, 196.10 ASPu/gm, is within the plus or minus 5.0% accuracy of the assay method, the Acid Stable Protease retains its activity during formulation, processing, and casting and remains unaffected when stored at ambient temperatures in suitable packaging.

Use conditions of the urinal block are well within the effective norms of the Acid Stable Protease, in pH, temperature and substrate encountered as indicated by Graph Nos. I (pH Stability), II (pH & Activity), III (Temperature & Activity), and IV (Heat Stability). The acid buffered enzyme will hydrolyze proteinaceous constituents found in urine, including urea, which will be converted to carbon dioxide and ammonia. The released ammonia will react with the acid phosphate buffers, which is used to stabilize the Acid Stable Protease. This eliminates the ammonia odors commonly encountered in most public, institutional and industrial restrooms.

It is to be understood that various modifications within the scope of this invention can be made by one of ordinary skill in the art without departing from the spirit thereof. The invention should be defined by the scope of the appended claims as broadly as the prior art will permit, and various changes may be made and equivalents may be substituted for elements thereof without departing from the broader aspects of the invention.

TABLE 1

| DAY | ASPu/gm |
|---|---|
| 0 | 200 |
| 30 | 185 |
| 60 | 197.5 |
| 90 | 198 |
| 120 | 200 |
| THEORETICAL YIELD | 200 |
| AVERAGE YIELD | 196.1 |

ASPu/gm = Acid Stable Protease units per gram

What we claim is:

1. A urine deodorant chemical dispenser adapted to be placed over the urine and flush water drain opening on the bottom of a urinal for dispensing fluid-soluble chemicals, said dispenser comprising a dispenser body having:

a. an inner hollow portion adapted to be placed over said drain opening in the bottom of said urinal and having at least one opening at the top thereof for aeration and for reception of said urine and/or flush water to be directed to said drain opening; and b. a urinal deodorant chemical retention cup portion surrounding said hollow portion and defining a vertically extending annular chamber for holding a solid body of a water-soluble deodorant chemical, said annular chamber being defined by vertically extending inner and outer walls and a top wall, which walls prevent said chemical body from being contacted by urine and flush water at the sides and top of said chamber, the bottom of said annular chamber being open and exposed so that said solid chemical body is contacted by a momentary build-up of flush water around said drain opening; and c. a flange adapted to rest upon the bottom of said urinal and to space the bottom surface of the solid body of deodorant chemical in the open bottom of said annular chamber from the flange and the floor of the urinal, said flange extending outwardly from said outer wall of said retention cup portion, said body having at the bottom portion thereof apertures therein for directing said urine and flush water towards the dispensing opening and beneath the open bottom of said annular chamber of said retention portion where flush water builds up to contact the bottom of said solid body of deodorant chemical.

2. The dispenser of claim 1 wherein the flange of said dispensed body is substantially oval shaped.

3. The dispenser of claim 1 wherein the configuration of said hollow portion of said dispenser body allows said dispenser assembly to fit over a strainer located over said urinal dispensing opening.

4. The dispenser assembly of claim 1 wherein said retention cup portion is a transparent material.

5. The dispenser of claim 1 wherein said hollow portion, said retention cup portion and said perforated flange of said dispenser body are molded in one piece.

6. The dispenser assembly of claim 1 wherein said retention cup portion includes means for retaining said fluid-soluble chemical in a ready-for-use position within said cup portion.

7. The dispenser of claim 1 combined with a solid body of said deodorant chemical in said annular chamber with the exposed bottom portion thereof spaced above said flange.

* * * * *

UNITED STATES PATENT AND TRADEMARK OFFICE

CERTIFICATE OF CORRECTION

PATENT NO. : 5,489,415 Page 1 of 4

DATED : February 6, 1996

INVENTOR(S) : Eftichios Van Vlahakis et al.

It is certified that error appears in the above-indentified patent and that said Letters Patent is hereby corrected as shown below:

Column 3, after line 5, insert Table I erroneously found at Column 10, lines 30-40.

Column 10, after line 20, insert the following Graphs I, II, III and IV.

GRAPH I

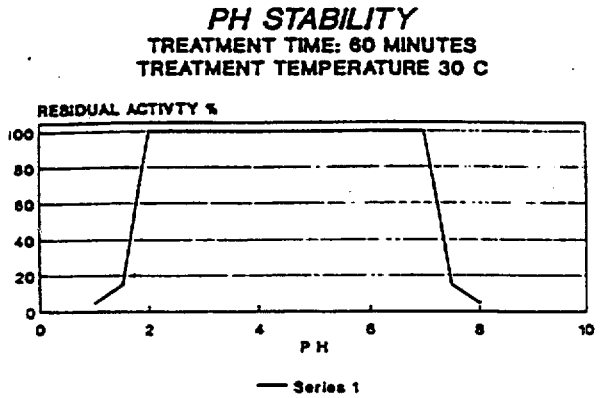

PH 2.0 - 2.5 : HCL-KCL BUFFER
PH 3.0 - 6.0 : LACTATE BUFFER
PH 6.0 - 8.0 : PHOSPHATE BUFFER

UNITED STATES PATENT AND TRADEMARK OFFICE

CERTIFICATE OF CORRECTION

PATENT NO. : 5,489,415 Page 2 of 4

DATED : February 6, 1996

INVENTOR(S) : Eftichios Van Vlahakis et al.

It is certified that error appears in the above-indentified patent and that said Letters Patent is hereby corrected as shown below:

GRAPH II

*PH & ACTIVITY*

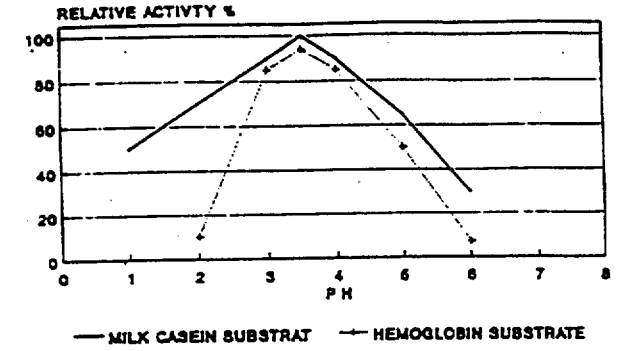

PH 2.0 - 2.5 : HCL-KCL BUFFER
PH 3.0 - 5.0 : LACTATE BUFFER
PH 6.0 - 7.0 : PHOSPHATE BUFFER

UNITED STATES PATENT AND TRADEMARK OFFICE

CERTIFICATE OF CORRECTION

PATENT NO. : 5,489,415

DATED : February 6, 1996

INVENTOR(S) : Eftichios Van Vlahakis et al.

It is certified that error appears in the above-indentified patent and that said Letters Patent is hereby corrected as shown below:

GRAPH III

*TEMPERATURE & ACTIVTY*

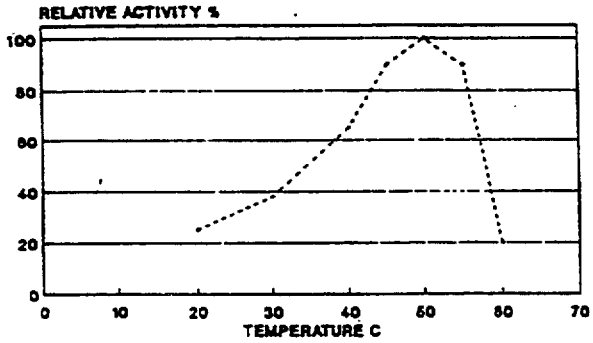

UNITED STATES PATENT AND TRADEMARK OFFICE

CERTIFICATE OF CORRECTION

PATENT NO. : 5,489,415

DATED : February 6, 1996

INVENTOR(S) : Eftichios Van Vlahakis et al.

It is certified that error appears in the above-indentified patent and that said Letters Patent is hereby corrected as shown below:

GRAPH IV

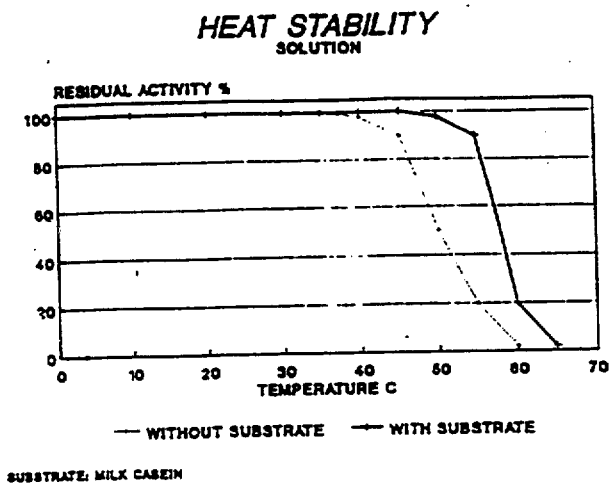

Signed and Sealed this

Tenth Day of September, 1996

*Attest:*

BRUCE LEHMAN

*Attesting Officer*

*Commissioner of Patents and Trademarks*